United States Patent [19]

Salk

[11] 4,024,521

[45] May 17, 1977

[54] ALARM INDICATOR CIRCUIT USING INDICATOR LAMPS

[75] Inventor: Donald Salk, Cranston, R.I.

[73] Assignee: Sheldahl, Inc., Northfield, Minn.

[22] Filed: Aug. 20, 1975

[21] Appl. No.: 606,309

[52] U.S. Cl. ..... 340/253 B; 315/135; 340/267 R

[51] Int. Cl.[2] ..... G08B 23/00

[58] Field of Search ..... 340/253, 252, 248, 213 R, 340/267 R, 176, 251, 415; 315/131, 133, 135; 318/490

[56] References Cited

UNITED STATES PATENTS

| | | | |
|---|---|---|---|
| 2,112,228 | 3/1938 | Crago | 340/213 R |
| 2,839,743 | 6/1958 | Baumgartner | 340/253 C |
| 2,943,303 | 6/1960 | Barber | 340/213 R |
| 3,641,490 | 2/1972 | Kawai | 340/251 X |

FOREIGN PATENTS OR APPLICATIONS

| | | | |
|---|---|---|---|
| 11,922 | 2/1956 | Germany | 340/176 |

*Primary Examiner*—John W. Caldwell
*Assistant Examiner*—Daniel Myer
*Attorney, Agent, or Firm*—Orrin M. Haugen

[57] ABSTRACT

An alarm indicator system which is utilized in combination with electrically energized apparatus, the alarm indicator including a plurality of individual indicator lamps for indicating an open-circuit condition in any one of a plurality of circuits. A master alarm lamp is provided which is energized upon the energization of any one of the individual or specific indicator lamps. The electrically energized apparatus includes, as is conventional, a plurality of drive means functioning from a source of electrical power,with relay means having normally open contacts being utilized upon closure to deliver power to the drive means of the apparatus. The master alarm lamp is arranged in parallel circuit arrangement with each of the indicator lamps, and a plurality of unidirectional conducting means such as diodes are interposed in series between the master alarm lamp and each of the normally closed contacts, with the unidirectional conducting means being uniformly poled with respect to the source of electrical power and with respect to each other so as to conduct in the same direction of current flow and effectively couple the master alarm lamp to each of the indicator lamps, while electrically isolating each of the indicator lamps, one from the other.

3 Claims, 2 Drawing Figures

ALARM INDICATOR CIRCUIT USING INDICATOR LAMPS

BACKGROUND OF THE INVENTION

The present invention relates generally to an improved alarm indicator system, and more specifically to an alarm indicator system which employs visual alarm devices such as indicator lamps for indicating an abnormal condition in the controlled electrically energized apparatus. Frequently, in manufacturing establishments, continuously running machines are employed for carrying out one or more operations on devices beng prepared or manufactured and which move more or less continuously through the machine. One typical example of such an apparatus is a bag-making machine which fabricates flexible film product from an elongated web of film. These apparatus typically employ a plurality of drive means which function from a source of electrical power, with the drive means being, in turn, controlled by condition responsive control switches or means which may interrupt the flow of power to the apparatus upon detection of an unusual or anomalous condition. If an operator is in attendance at the time of the development of the unusual condition, an indicator lamp will normally light on a panel so as to warn the operator of the existence of the condition, and it may be remedied as required. However, in the event an operator is not immediately present, the energization of the indicator lamp due to the unusual condition may remain undetected for a period of time which may become sufficient to permit jamups or other situations to develop which, in turn, may require considerable down-time in order to remedy. The present invention provides for an alarm indicator system which, in addition to maintaining the integrity of the specific indicator lamp, also provides a master alarm lamp which will become actuated upon the actuation of any one of the specific indicator lamps. Means are provided so as to permit the master alarm lamp to become actuated concurrently with the actuation or lighting of any one or more of the individual indicator lamps, and means are provided to effectively electrically isolate each of the individual indicator lamps, one from the other, so as to preserve the specific condition of the actuated indicator lamp, while avoiding energization of other indicator lamps which may be coupled to the same source of electrical power.

SUMMARY OF THE INVENTION

Briefly, in accordance with the present invention, an alarm indicator system has been developed for use with apparatus which is electrically energized, and has a plurality of active energy utilizing means functioning from a common source of electrical power. Condition responsive control switch means such as relays, are provided which have two sets of contacts, one being normally open and the other being normally closed, for controlling the delivery of power to the electrically energized means. An indicator lamp is arranged in circuit with each of the normally closed contacts for visually indicating a condition wherein the switch means become coupled across the normally closed contacts, thus indicating the occurrence of an interrupt in the delivery of power to the electrically energized means. A master alarm lamp, as has been indicated, is in parallel circuit arrangement with each of the individual indicator lamps. A plurality of unidirectional conducting means is also provided, one of said unidirectional conducting means being interposed in series between the master alarm lamp and the normally closed contact, the unidirectional conducting means being uniformly poled with respect to the source of electrical power, and with respect to each other for preserving the integrity of the individual indicator lamps, one from the other.

Therefore, it is a primary object of the present invention to provide an improved alarm indicator system for electrically energized apparatus wherein individual indicator lamps are provided for providing a visual indication of a malfunction or interruption in the flow of power to the apparatus, and wherein a master alarm lamp is provided for energization upon the energization of any one of the plurality of individual indicator lamps.

It is a further object of the present invention to provide an improved alarm indicator system which employs a plurality of parallelly coupled electrical loads, each being controlled by condition responsive control switch means having normally open and normally closed contacts, and wherein the normally closed contacts are coupled to an indicator lamp for visually indicating a condition wherein the switch means are coupled across the normally closed contacts, and wherein a master alarm lamp means is provided in parallel circuit arrangement with each of the individual indicator lamps, with a plurality of unidirectional conducting means being provided to effectively preserve the integrity of each of the individual indicator lamps, one from the other, while effectively coupling the master alarm lamp means to each of the individual indicator lamps.

Other and further objects of the present invention will become apparent to those skilled in the art upon a study of the following specifications, appended claims, and accompanying drawings.

DESCRIPTION OF THE PREFERRED EMBODIMENT

Figure 1:
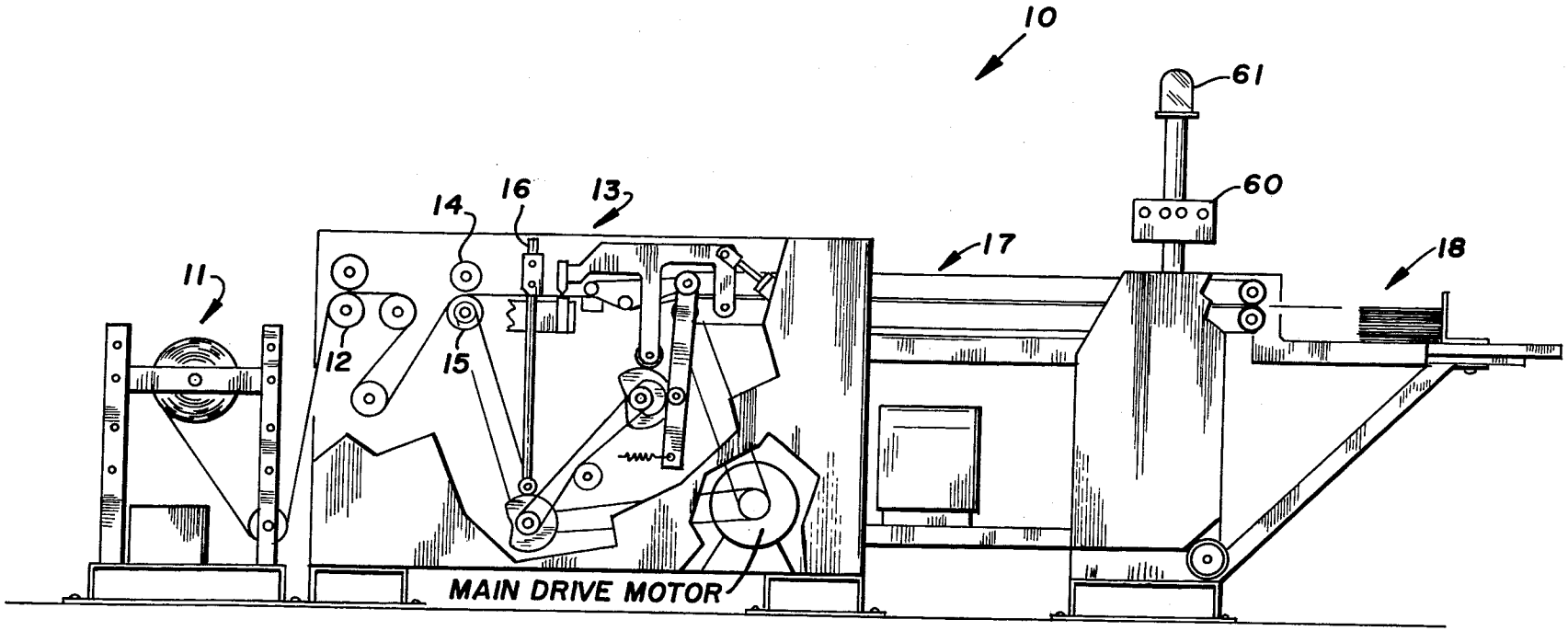
FIG. 1 is a side elevational view, partially in section and partially broken away, and illustrating a conventional bag-making machine which employs a single source of electrical power for driving the individual segments or attachments of the machine, and wherein the alarm indicator system of the present invention is provided so as to provide a visual indication of a malfunction or circuit interrupt in the apparatus.

As has been indicated, the alarm indicator system of the present invention is shown as attached to a conventional polyethylene bag machine, it being understood, of course, that the system has application in connection with other apparatus and machinery as well. In FIG. 1, the bag machine generally designated 10 includes an unwind section 11, the unwind section 11 including a capstan drive for removal of web from the supply roll, the capstan roll being shown at 12. Compensators are conventionally employed in combination with the unwind mechanism to control tension of the web as it is being fed to the downsteam sections of the apparatus, the compensator sections frequently controlling the rate of drive for the capstan roll 12. The hot knife section shown generally at 13 includes that portion of the apparatus wherein a number of operations are conducted on the film web, including measuring of the web draw length, sealing of the web, and ultimate cut-off. Frequently, the hot knife section includes a variety of electrical components, timing devices and drive means for the overall machine, as will be more fully explained hereinafter. In order to accomplish measuring of the web, draw rolls are provided as at 14 and 15, the draw rolls operating intermittently and in time with the hot knife sealing bar 16. A conveyor section is provided as at 17 for removal of product from the hot knife section, preparatory to stacking on the stacking table arrangement as at 18. Typically, in machines of this type, a number of control systems will be required and provided, and in the event the control function fails for one reason or another, or the work becomes jammed, safety switches and/or limit switches are provided for turning the main power off and thereby de-activate the machine until remedial measures are taken.

As can be appreciated, the individual sections of the equipment are powered by a main power motor, along with auxiliary motors, with the main power motor including a number of condition responsive control devices such as condition responsive control switch means. When the apparatus is functioning normally, the individual condition responsive control switch means will be coupled across the normally open contacts for delivering power to the drive means or active portions of the structure. However, when malfunctions or anomalous conditions develop, the condition responsive control switch means will respond or react so as to open the contacts and apply power across the normally closed contacts. The system of the present invention utilizes the normally closed contacts for providing an indication of the occurrence of the malfunction or anomalous condition.

Figure 2:
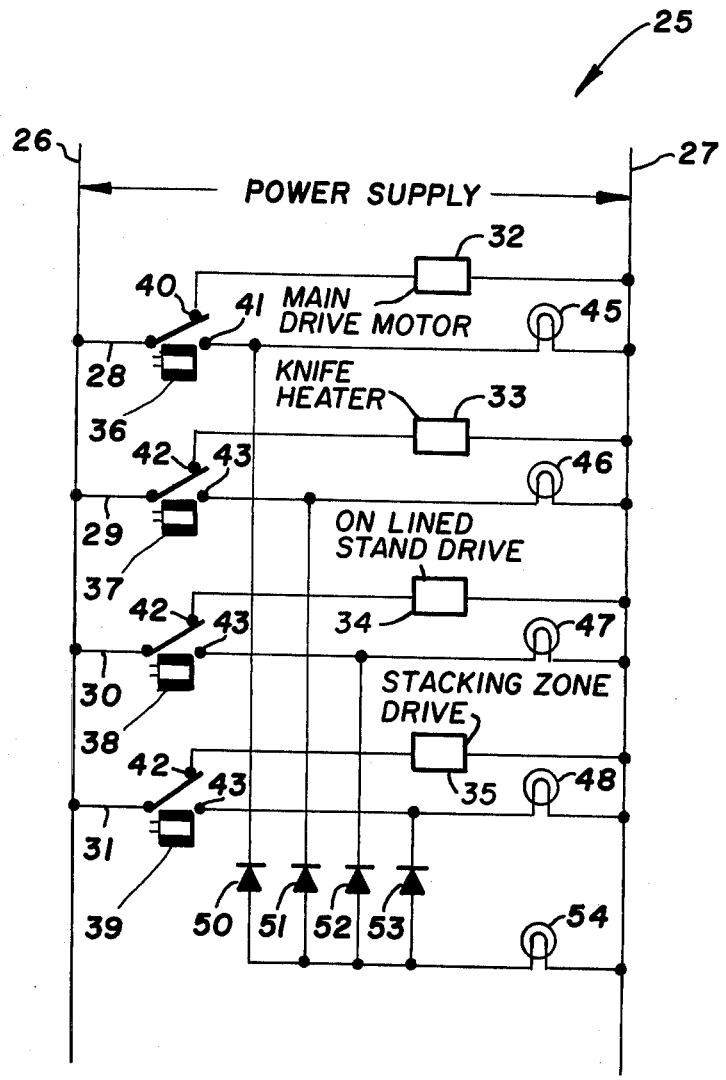
FIG. 2 is a schematic diagram of the alarm indicator system of the present invention.

Attention is now directed to FIG. 2 of the drawings wherein a schematic illustration sets forth a typical system capable of functioning in accordance with the present invention. In this connection, the system illustrated generally at 25 includes a pair of power means 26 and 27 which constitute the power supply for the equipment, including the bag machine 10. Coupled in parallel across the means 26 and 27 are a series of control circuits including control circuits 28, 29, 30 and 31. Each circuit is coupled to a load member as is indicated at 32, 33, 34 and 35, with these loads being, in turn, coupled to the normally open contacts as will be more fully explained hereinafter.

For controlling the delivery of power to the individual load members, control relays are provided as at 36, 37, 38 and 39, with each of these relays including a pair of contacts with a normally open contact as at 40 in relay 36, and a normally closed contact as at 41. Relays 37, 38 and 39 are likewise provided with a pair of contacts including a normally open contact as at 42-42 and a normally closed contact as at 43-43.

In circuit with the normally closed contacts there is an individual or specific indicating lamp as at 45, 46, 47, and 48, with each of these lamps having, in parallel therewith, unidirectionally conducting devices such as the diodes shown at 50, 51, 52 and 53. In series with the diodes 50-53 inclusive, there is a master alarm lamp as at 54. Specifically, the circuitry is such that the individual unidirectonal conducting means are coupled to the normally closed contacts with each being uniformly poled with respect to the source of electrical power and with respect to each other so as to conduct in the same direction of current flow, thereby effectively electrically coupling the master alarm lamp 54 to the individual indicator lamps, while electrically isolating each of the individual indicator lamps, one from the other.

Relating this system to the apparatus in FIG. 1, load 32 may be characterized as the main drive motor which supplies the power to the draw rolls, the sealing bar drive, as well as the conveyor drive. Relay 36, for example, may designate one of several control relays or condition responsive devices, in this instance, a jam detector adjacent the draw rolls. Such jam detectors are, of course, commercially available. Alternatively, or in addition, sensors may be in the form of overload detectors for the main drive, or for the conveyor drive. Upon detecting of an unusual condition, relay 36 responds through de-energization of the coil and releasing the armature so as to move the contact spring to the normally closed position, thereby making contact with contact 41. Such condition will energize indicator lamp 45, and permit the flow of unidirectional current through diode 50 so as to energize or light lamp 54. The integrity of the remaining indicator lamps 46, 47 and 48 will be preserved by virtue of the inter-positioning of diodes 51, 52 and 53 respectively.

In the embodiment illustrated, load 33 may be illustrative of the power to the hot knife, with a high and low temperature limit control being utilized to activate the relay coil of relay 37. In this arrangement, therefore, upon detection of either a high or low temperature, inactivation of the coil of relay 37 will cause the armature to move to its normally closed position and thereby bridge the contact 43 so as to energize indicator lamp 46. Loads 34 and 35 may be indicative of the driven unwind stand or the capstan section when appropriate, and for the energization of a stacking zone respectively.

While condition responsive switches have been indicated as being relays in the form of relays 36, 37, 38 and 39, it will be appreciated that a mechanical motion detector functioning between upper and lower limits may be employed as well. Such a device may be in the form of a bi-metallic switch, dancer roll contact arm, or the like, wherein normally closed and normally open contacts are available to respond to the position of the detector device.

In certain applications, it will be desirable to arrange the control for the main power source in series with a group of parallelly arranged control circuits. Such a circuit arrangement will provide a system wherein interruption of power to any one of the control circuits will provide an interrupt of power for the main drive motor, thus shutting down the entire operation. As an alternate, it may be possible to selectively gang certain of the movable contact springs together so as to achieve simultaneous opening of various circuits in the event of a certain specific malfunction or development of an anomalous condition. The specific requirements of the arrangement will normally dictate the circuit arrangement, and such circuit arrangements will, of course, be straightforward and obvious to those skilled in the art.

In an actual installation, the individual indicator lamps 45, 46, 47 and 48 will normally be disposed on a panel arrangement on the apparatus, and one such panel is illustrated at 60 in the drawings at FIG. 1. In addition, however, the master alarm lamp is illustrated at 61, with the master alarm lamp being elevated a significant distance above the base of the device so as to alert the operator who may be at a point remote from the machine being shut down.

For most malfunctioning conditions, the power to the main drive motor is interrupted so as to prevent the continuation of the running of the machine so as to compound the problem. Certain other operational conditions may merely require a visual indication to the operator in order that corrective action may be taken without necessarily interrupting the operation of the device.

I claim:

1. In combination, electrically energized apparatus having a plurality of operational drive means functioning from a single common source of electrical power, an alarm indicator system having a plurality of condition responsive control switch means, each switch means having a normally open and a normally closed contact and coupled for controlling the delivery of current to said drive means through said normally open contacts and to said indicator lamps through said normally closed contacts for visually indicating a condition when said control switch means are coupled across said normally closed contacts, said combination including:

a. master alarm lamp means in parallel circuit arrangement with each of said indicator lamps and including a plurality of unidirectional conducting means, one of said unidirectional conducting means being interposed in series between said master alarm lamp and each of said normally closed contacts, each of said unidirectional conducting means being uniformly poled with respecct to said source of electrical power and with respect to each other to facilitate conduction in the same direction of current flow to effectively electrically couple each of said indicator lamps to said master alarm lamp, while electrically isolating each of said indicator lamps, one from the other.

2. The combination as defined in claim 1 being particularly characterized in that said master alarm lamp is arranged remote from said indicator lamps.

3. The combination as defined in claim 1 being particularly characterized in that said normally open and normally closed contacts are relay contacts actuated by a single coil.

* * * * *